US007174821B2

(12) United States Patent
Geffros

(10) Patent No.: US 7,174,821 B2
(45) Date of Patent: Feb. 13, 2007

(54) PUNCH FOR A BRACED DIE

(75) Inventor: Michael Rupert Geffros, Fort Gratiot, MI (US)

(73) Assignee: Ontario Die International Inc., Kitchener (CA)

( * ) Notice: Subject to any disclaimer, the term of this patent is extended or adjusted under 35 U.S.C. 154(b) by 108 days.

(21) Appl. No.: 11/000,122

(22) Filed: Nov. 30, 2004

(65) Prior Publication Data

US 2005/0132856 A1 Jun. 23, 2005

Related U.S. Application Data

(63) Continuation of application No. PCT/CA2004/002055, filed on Nov. 29, 2004.

(60) Provisional application No. 60/525,882, filed on Dec. 1, 2003.

(30) Foreign Application Priority Data

Feb. 19, 2004 (CA) ..... 2458309

(51) Int. Cl.

| | |
|---|---|
| ***B26D 7/18*** | (2006.01) |
| ***B26D 7/26*** | (2006.01) |
| ***B26F 1/14*** | (2006.01) |
| ***B26F 1/44*** | (2006.01) |
| *B21K 5/12* | (2006.01) |

(52) U.S. Cl. ..... 83/684; 83/86; 83/695; 83/698.91; 76/107.8

(58) Field of Classification Search ..... 83/86, 83/97, 164, 165, 620, 621, 667, 669, 678, 83/682, 684, 691, 695, 697, 698.71, 698.91, 83/699.11; 766/107.1, 107.8
See application file for complete search history.

(56) References Cited

U.S. PATENT DOCUMENTS 190,683 A * 5/1877 Jenkins ..... 83/128
341,204 A 5/1886 Adler (Continued)

FOREIGN PATENT DOCUMENTS

DE 4304030 8/1994

(Continued)

OTHER PUBLICATIONS

ODC International Inc. "Dieverse Product Development", pp. 1-3, Nov. 1999.

*Primary Examiner*—Clark F. Dexter
(74) *Attorney, Agent, or Firm*—Jaeckle Fleischmann & Mugel, LLP.

(57) ABSTRACT

A punch for attachment to a brace of a braced die has a hollow cutting nose with a leading end for cutting a material to be punched and a trailing end opposite the leading end. A shaft extends from the trailing end of the nose and is sized to pass through an aperture in a brace. An upper retainer is joined to the shaft and has an upper retaining surface adapted to abut an upper surface of a brace. A lower retainer is joined to the shaft and has a lower retaining surface adapted to abut a lower surface of a brace. An internal waste evacuation chute extends from the interior of the hollow cutting nose and through the shaft for evacuating plugs of punched material from the nose.

10 Claims, 3 Drawing Sheets

U.S. PATENT DOCUMENTS

| | | | | | |
|---|---|---|---|---|---|
| 407,242 | A | * | 7/1889 | Quinn | 83/691 |
| 518,596 | A | | 4/1894 | Gibbs | |
| 528,240 | A | | 10/1894 | Sievert | |
| 801,358 | A | * | 10/1905 | Casey | 83/86 |
| 961,653 | A | * | 6/1910 | Setter | 83/164 |
| 1,018,520 | A | | 2/1912 | Prime | |
| 1,177,055 | A | | 3/1916 | Reed | |
| 1,279,362 | A | * | 9/1918 | Krueger | 83/690 |
| 1,321,896 | A | | 11/1919 | Davis | |
| 1,646,413 | A | | 10/1927 | Lossmann | |
| 1,737,500 | A | | 11/1929 | Johnson | |
| 1,942,145 | A | * | 1/1934 | Knight | 83/682 |
| 1,942,539 | A | * | 1/1934 | Deubel | 83/684 |
| 1,976,992 | A | * | 10/1934 | Hinds | 83/164 |
| 2,097,693 | A | | 11/1937 | Foster | |
| 2,100,846 | A | * | 11/1937 | Halstead | 83/164 |
| 2,239,377 | A | * | 4/1941 | Altvater | 12/142 V |
| 2,313,801 | A | | 3/1943 | Carll | |
| 2,395,083 | A | | 2/1946 | Wilson | |
| 2,514,659 | A | * | 7/1950 | McClung | 83/126 |
| 2,550,299 | A | | 4/1951 | Sabo | |
| 2,588,809 | A | | 3/1952 | Demarest | |
| 2,899,849 | A | | 8/1959 | Laughter et al. | |
| 3,048,069 | A | | 8/1962 | Berlin et al. | |
| 3,049,039 | A | | 8/1962 | Wright | |
| 3,111,877 | A | | 11/1963 | Rugenstein | |
| 3,152,492 | A | * | 10/1964 | Whitecotton | 76/107.8 |
| 3,170,342 | A | | 2/1965 | Downie | |
| 3,188,900 | A | | 6/1965 | Mauro | |
| 3,205,750 | A | | 9/1965 | Strange | |
| 3,335,628 | A | | 8/1967 | Simms et al. | |
| 3,340,758 | A | | 9/1967 | Peterson et al. | |
| 3,352,187 | A | | 11/1967 | Knight | |
| 3,373,643 | A | | 3/1968 | Spengler | |
| 3,411,208 | A | | 11/1968 | Malm | |
| 3,482,478 | A | * | 12/1969 | Einhorn | 83/100 |
| 3,568,554 | A | * | 3/1971 | Wiechec | 83/98 |
| 3,599,520 | A | | 8/1971 | Wood | |
| 3,626,799 | A | | 12/1971 | Gerber et al. | |
| 3,635,115 | A | | 1/1972 | Rickenbacher | |
| 3,705,526 | A | | 12/1972 | Bishop | |
| 3,739,676 | A | | 6/1973 | Gerdin | |
| 3,752,042 | A | | 8/1973 | Castille | |
| 3,797,351 | A | | 3/1974 | Jones, Jr. | |
| 3,805,657 | A | | 4/1974 | Simpson | |
| 3,826,170 | A | | 7/1974 | Jones et al. | |
| 3,882,614 | A | | 5/1975 | Albaladejo | |
| 3,945,287 | A | | 3/1976 | Dvorak | |
| 3,982,458 | A | | 9/1976 | Terasaka | |
| 4,226,143 | A | | 10/1980 | Whitecotton et al. | |
| 4,250,786 | A | | 2/1981 | Bleich | |
| 4,476,762 | A | | 10/1984 | Anderson et al. | |
| 4,494,426 | A | | 1/1985 | Hartzell | |
| 4,601,228 | A | | 7/1986 | Steadman et al. | |
| 4,607,553 | A | | 8/1986 | Hartzell | |
| 4,684,613 | A | * | 8/1987 | Barrere et al. | 435/286.3 |
| 4,754,677 | A | | 7/1988 | McKindary | |
| 4,829,854 | A | | 5/1989 | Kammerling-Essmann | |
| 4,878,407 | A | | 11/1989 | Harrison et al. | |
| 4,884,484 | A | | 12/1989 | Bakermans et al. | |
| 4,921,154 | A | | 5/1990 | Abe et al. | |
| 4,981,061 | A | | 1/1991 | Hillock et al. | |
| 5,129,295 | A | | 7/1992 | Geffros et al. | |
| 5,275,076 | A | | 1/1994 | Greenwalt | |
| 5,402,698 | A | | 4/1995 | Morrison | |
| 5,515,749 | A | | 5/1996 | Sandford | |
| 5,520,080 | A | | 5/1996 | Sandford | |
| 5,676,032 | A | | 10/1997 | Johnson | |
| 5,875,699 | A | | 3/1999 | Koelsch | |
| 5,983,766 | A | | 11/1999 | Johnson | |
| 6,233,809 | B1 | | 5/2001 | Geffros et al. | |
| 6,658,978 | B1 | | 12/2003 | Johnson | |
| 6,912,941 | B2 | * | 7/2005 | Johnson | 83/78 |

FOREIGN PATENT DOCUMENTS

| | | |
|---|---|---|
| WO | WO 89/06184 | 7/1989 |
| WO | WO 98/09781 | 3/1998 |

* cited by examiner

PUNCH FOR A BRACED DIE

This application is a continuation of International Application No. PCT/CA2004/002055 filed Nov. 29, 2004 and claims the benefit under 35 U.S.C. 119(e) of U.S. Provisional Application Ser. No. 60/525,882 filed Dec. 1, 2003 and claims priority from Canadian Patent Application No. 2,458,309, filed Feb. 19, 2004. Provisional Application Ser. No. 60/525,882, Canadian Patent Application No. 2,458,309, and International Application No. PCT/CA2004/002055 are incorporated herein, in their entirety, by this reference to them.

FIELD OF THE INVENTION

This invention relates to a punch for a braced die and a method for producing parts for a braced die with a punch.

BACKGROUND OF THE INVENTION

U.S. Pat. No. 6,233,809 describes a cutting knife that can be detachably connected to a baseboard. The cutting knife extends in a perpendicular direction to the baseboard and circumscribes the knife cavity on the baseboard. At least one elongated brace (or cross member) is affixed to the cutting knife and extends across knife cavity. The brace is mounted to the baseboard by a removable fastener. The cutting knife may then be removed from the baseboard and re-secured.

SUMMARY OF THE INVENTION

It is an object of the invention to improve on the prior art. Other objects of the invention include providing a punch for a braced die, a method for securing a punch to a brace for a die, or a method of making parts of a braced die with a punch. The punch may be a flow-through punch. One or more of these objects are met by the combination of features, steps or both found in the claims. The following summary is not intended to define the invention but to introduce the reader to various aspects of it.

In one aspect of the invention, a punch for a braced die is provided. The punch has a cutting nose with a leading end for cutting a material to be punched and a trailing end opposite the leading end. A shaft extends from the trailing end of the nose and is sized to pass through an aperture in a brace. An upper retainer is joined to the shaft and has an upper retaining surface adapted to abut an upper surface of a brace. A lower retainer is joined to the shaft and has a lower retaining surface adapted to abut a lower surface of a brace. An internal waste evacuation chute extends from the interior of the hollow cutting nose and through the shaft for evacuating plugs of punched material from the nose.

The upper retainer can be part of the cutting nose and can include an abutment adjacent the trailing end of the cutting nose. The abutment can be a flange integrally joined to the shaft. The lower retainer can include a nut engaged with a threaded portion of the shaft.

According to another aspect of the invention, a die assembly for cutting a desired pattern from sheet material is provided. The assembly includes a flexible steel cutting knife arranged around a cavity defining the perimeter of a desired pattern, at least one brace extending between portions of the cutting knife on opposed sides of the cavity, and a punch, as described above, which may be a punch secured to the cross brace and positioned to punch a hole from a sheet of material in a desired location relative the perimeter.

The die assembly can further comprise a baseboard or backboard to support the die and at least one brace can be secured to the baseboard. The baseboard can have a clearance aperture extending through the thickness of the baseboard and the clearance aperture can be in alignment with the waste evacuation chute of the punch for evacuating waste material from the hollow punch nose through the baseboard. At least a portion of at least one the shaft and the lower retainer can be received in the clearance aperture.

According to another aspect of the invention, a die assembly has a baseboard and a cutting knife defining the perimeter of a cavity. A punch is secured to the baseboard within the perimeter. The punch has a cutting nose, having a cutting edge and a trailing end opposite the cutting edge. A shaft extends from the trailing end of the cutting nose into a clearance aperture passing through the baseboard. The punch has an evacuation chute passing through it from the cutting edge to a distal end of the shaft. The evacuation chute has a first section in the cutting nose with a first diameter less than the diameter of the cutting edge which may temporarily hold plugs of a cut material. The evacuation chute also has a second position, starting from the opposite side of the first portion and extending through the shaft, having a second diameter. The second diameter is larger than the diameter of the cutting edge and may let plugs of cut material fall to and through the shaft.

According to another aspect of the invention, a method of making a die with a punch is provided. The method includes arranging at least one flexible knife in a desired pattern around a die cavity, making at least one cross brace to attach between portions of the knife and across the cavity, and providing at least one punch aperture in a desired location in the cross brace. The method further includes securing at least one knife to ends of the cross brace, and securing a punch in the at least one punch aperture. A brace cutting machine can be used to produce the at least one punch aperture in the brace.

BRIEF DESCRIPTION OF THE DRAWINGS

One or more embodiments of the invention will now be described, by way of example, with reference to the following figures, wherein.

DETAILED DESCRIPTION OF EMBODIMENTS

Figure 1:
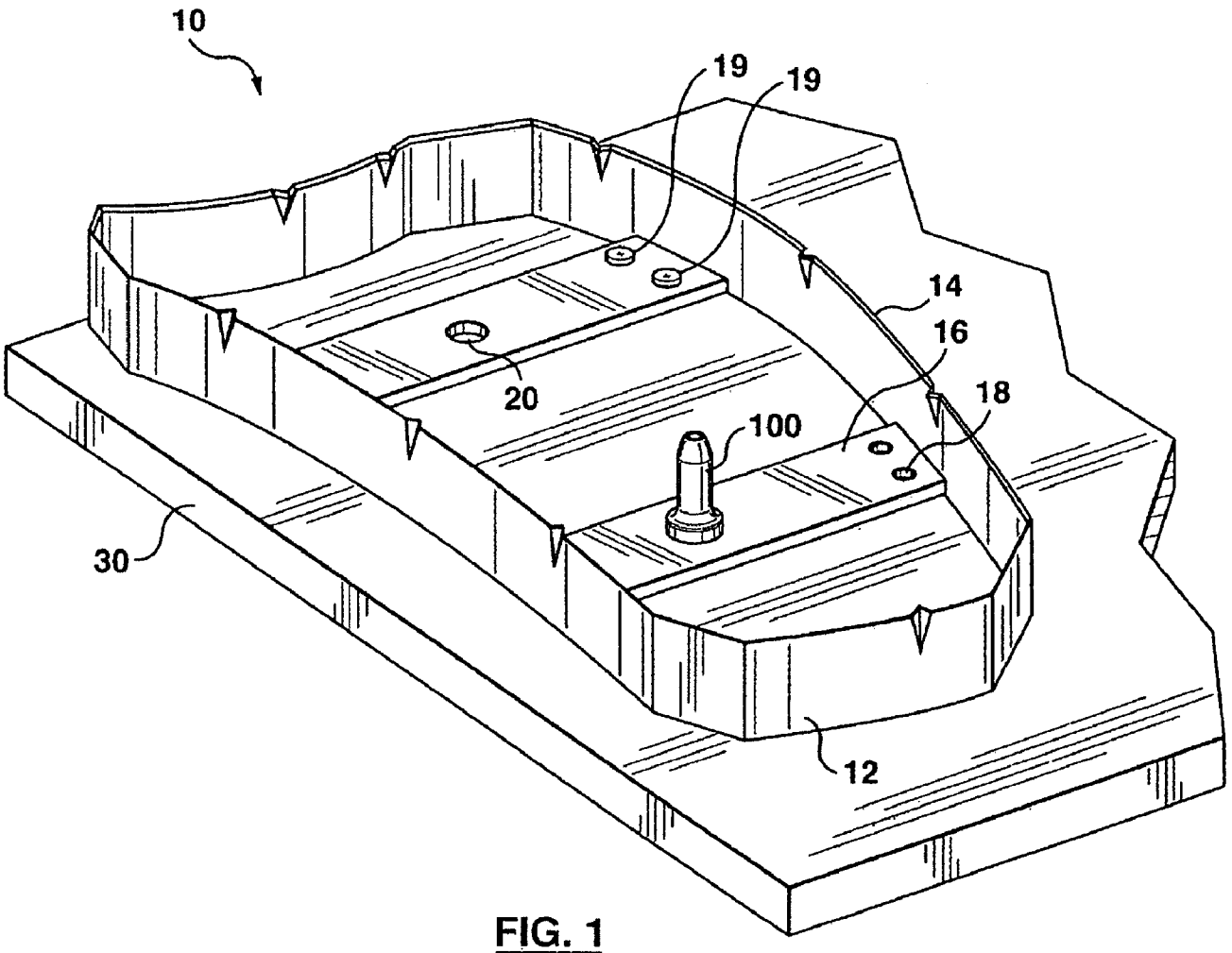
FIG. 1 is an isometric view of a braced cutting die.

A cutting die assembly in accordance with the present invention is shown generally at 10 in FIG. 1. The die assembly 10 has a knife 12 constructed from a strip of material having a cutting edge 14 on one of its sides. The knife 12 is bent at various angles to provide a closed shape or cavity defined by the point of the cutting edge 14. The knife 12 is typically made from steel.

The die 10 also has braces 16 which serve a number of purposes. The braces 16 may do one or more of supporting the knife 12, helping to maintain the shape of the die 10, distributing the forces from the die 10 to a baseboard 30, providing a means for mounting dies to a baseboard 30 or providing a means for mounting other items, such as cutouts, punches, stabs or slit knives, to the die 10.

The braces 16 are typically located within the area bounded by the knife 12 to avoid interfering with any adjacent dies mounted to the same baseboard 30. The braces 16 are typically made of steel and welded at their ends to other braces 16 or to the knife 12. The braces may be cut from a strip material, their ends being cut to match the inner surface of knife 12, or any other surface to which they are attached, to within the tolerances required by welding or any other method of attachment used. In the case of a die 10 intended to be mounted flush with the surface of the baseboard 30, the braces 16 may be mounted flush with the non-cutting edge of the knife 12 and include holes 18 for inserting a fastener 19, such as a screw, to attach the die 10 to the baseboard 30. Further details of a die for use in accordance with the present invention are described in U.S. Pat. No. 6,233,809, which is incorporated herein in its entirety by this reference to it.

The braces 16 can further be provided with punch apertures 20 for attaching punches 100 to the die assembly 10. In the embodiment illustrated, the punch apertures 20 are holes, only one of which is visible, that are positioned relative to the cutting edges 14 of the knife 12 so that an assembled punch 100 produces a punched cut-out in a desired location. In the drawing of FIG. 1, the die 10 shown is only partially assembled and only partially secured to the baseboard 30 to allow some holes 18 and an aperture 20 to be visible. In a completed assembly, a second punch 100 would be attached in the visible aperture 20 and additional fasteners 19 would be provided in the open holes 18. In other dies 10 the number of holes 18 and apertures 20 may vary.

Figure 2:
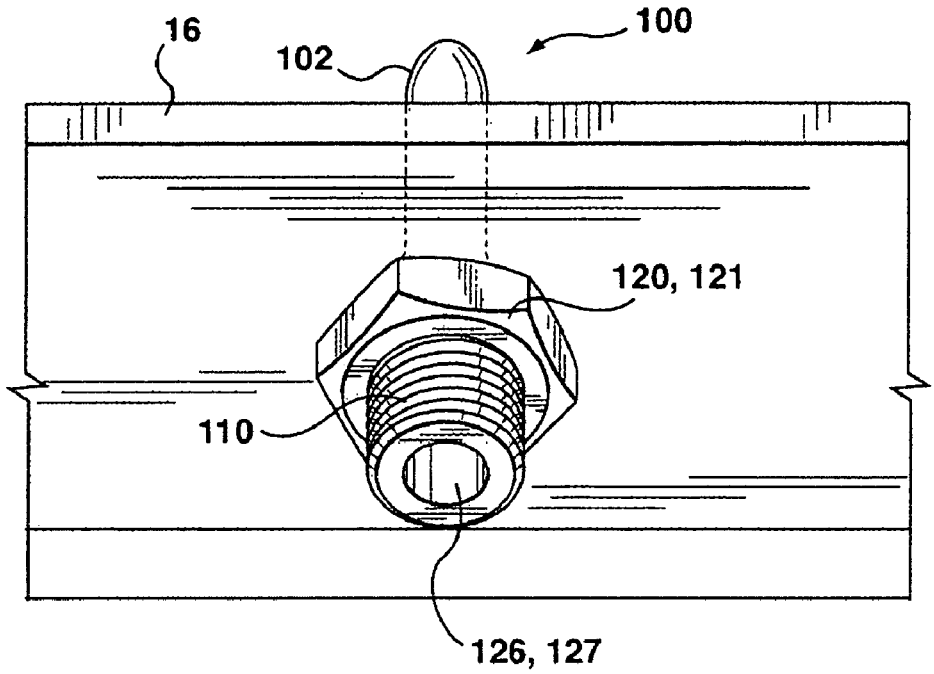
FIG. 2 is an isometric view of a punch attached to the braced die of FIG. 1.
Figure 3:
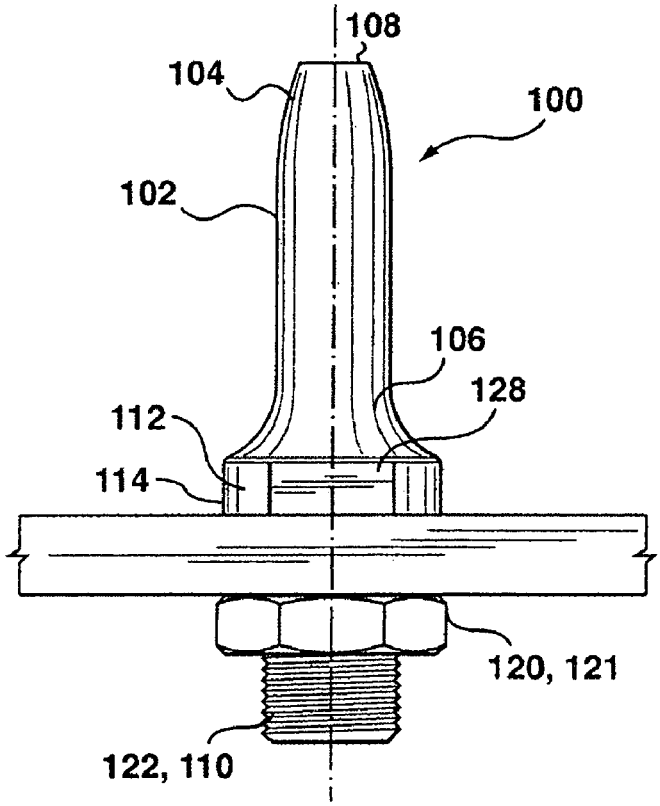
FIG. 3 is a front view of the punch of FIG. 2.
Figure 5:
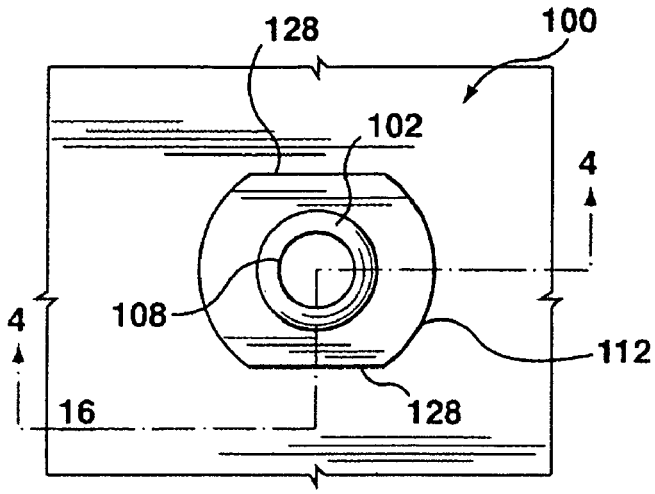
FIG. 5 is top view of the punch of FIG. 3.

A punch 100 for attachment to the braces 16 is shown in greater detail in FIGS. 2 and 3. The punch 100 has a hollow cutting nose 102, with a leading end 104 at one end of the body of the cutting nose 102 and a trailing end 106 opposite the leading end 104. The leading end 104 of the cutting nose 102 has a cutting edge 108 for cutting a material to be punched.

The punch 100 has a shaft 110 extending from the trailing end 106 of the nose 102. The shaft has an outer diameter that is small enough to pass through one of the punch apertures 20 in the brace 16 where the punch 100 is to be attached to the brace 16. In the embodiment illustrated, the shaft 110 and the nose 102 of the punch 100 are integrally joined together.

The punch 100 is further provided with an upper retainer 112 for mounting the punch 100 to the brace 16. In the embodiment illustrated, the upper retainer 112 comprises an integral base portion 114 of the nose 102, adjacent the trailing end 106 of the nose 102. The upper retainer 112 is therefore also integrally joined to the shaft 110 in the embodiment illustrated. The base portion 114 of the nose 102 can be flared outwardly so that the diameter of the base portion 114 nearest the trailing end 106 is greater than the diameter nearest the leading end 104.

The upper retainer 112 provides an upper retainer surface 116 adapted to abut an upper surface 16*a* of the brace 16. In the embodiment illustrated, the upper retainer surface 116 is the lower face of the base portion 114 of the nose 102, opposite the leading end 104.

The punch 100 also has a lower retainer 120 joined to the shaft 110 for securing the punch 100 in the desired position to the brace 16. In the embodiment illustrated, the lower retainer 120 is a nut 121 that is screwed onto an externally threaded portion 122 of the shaft 110. The lower retainer 120 has a lower retainer surface 124 adapted to abut a lower surface (or underside surface) 16*b* of the brace 16.

The punch 100 may further be provided with an internal material evacuation chute 126 extending from the hollow cutting nose 102 and through the shaft 110 to evacuate plugs of cut or punched material from inside the cutting nose 102. More particularly, in the embodiment illustrated, the evacuation chute 126 comprises an axial bore that extends lengthwise through the punch 100, from the hollow nose 102 to an outlet 127 at the lower end of the shaft 110. The axial bore varies in diameter along its length having a first section adjacent the nose 102 with a first diameter to temporarily hold plugs of a first cut material followed by a second section with a larger diameter to let the plugs of the first material fall through when a second material is cut.

To assemble the punch 100 to the die 10, the shaft 110 of the punch 100 can be inserted through one of the punch apertures 20 in the brace 16, so that the upper retainer surface 116 of the upper retainer 112 abuts the upper surface 16*a* of the brace 16. The nut 121 can then be screwed onto the threaded portion 122 of the shaft 110, and tightened so that the lower retainer surface 124 of the lower retainer 120 bears against the underside 16*b* of the brace 16. In this way, an axial clamping force can be applied across the thickness of the brace 16 to hold the punch 100 securely in place. Wrench flats 128 can be provided on the outer surface of the nose 102 of the punch 100 to facilitate tightening of the nut 121.

The braces 16 can then be secured to the baseboard 30, so that the knife 12 of the die 10 is mounted to the baseboard 30. When attaching the braces 16 to the baseboard 30, the outlets 127 of the evacuation chutes 126 of the punches can be aligned with clearance apertures 32 provided in the baseboard 30. The clearance apertures 32 can extend through the thickness of the baseboard 30 to provide passage for plugs of cut material, and to accommodate a lower portion of the shaft 110 and the lower retainer 120, which may extend below the lower surface 16*b* of the braces 16.

In use, the cutting edge 108 cuts through a layer of material being cut by the die assembly 10, and a plug of material is left in the interior of the hollow nose 102. This plug of material can exit the hollow nose 102 under the force of gravity and/or the force of subsequent cutting operations by flowing through the evacuation chute 126, and passing through the aperture 32 provided through the baseboard 30.

Figure 4:
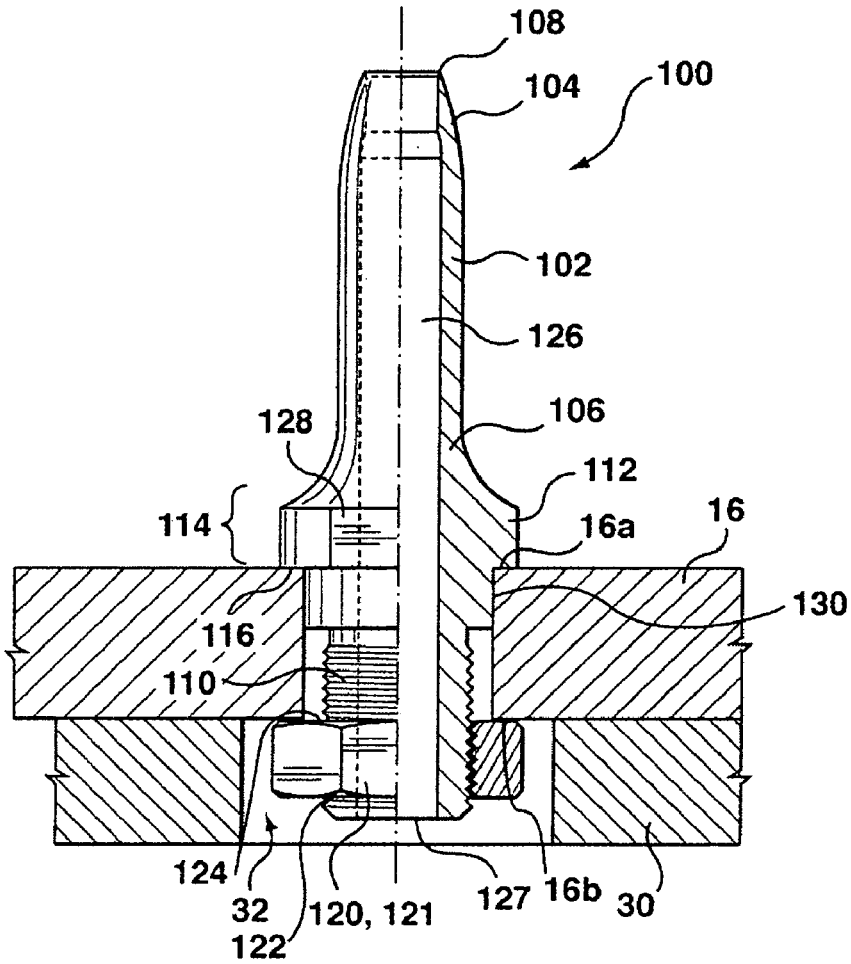
FIG. 4 is a partial cross-sectional view of the punch of FIG. 3.

Referring again to FIG. 4, the shaft 110 of the punch 100 can further be provided with a collar 130, positioned between the upper retainer 112 and the threaded portion 122. In the embodiment illustrated, the collar 130 comprises a stepped portion of the outer surface of the shaft 110 of the punch 100. The collar 130 has an outer diameter that is larger than that of the threaded portion 122, but smaller than that of the upper retainer 112. Furthermore, the outer diameter of the collar 130 is sized to provide a snug fit within the internal diameter of the punch hole 20 provided in the brace 16. The collar 130 can have an axial length that is slightly less than the thickness of the brace 16. When assembling the punch 100 to the brace 16, the collar 130 can facilitate accurate positioning of the punch 100 within the hole 20.

The present invention also comprehends a method of making a die assembly 10. One method according to the present invention involves arranging a flexible knife 12 in a desired pattern to define a die cavity; cutting at least one cross brace 16 with desired end configurations on the ends of the brace for attachment between portions of a knife on opposed sides of the cavity; providing punch apertures 20 in desired locations in the cross brace 16; securing the ends of the brace 16 to the knife 12; and, after the punch apertures 20 have been produced, securing a punch 100 as described above in the punch apertures 20.

Regarding the cutting of the braces 16, the braces 16 may be cut from a strip stock, typically of steel. Strip stock suitable for braces may come in a variety of widths ranging from about ⅝ to 2 inches or more, a variety of thickness ranging from about ⅛ to ¼ inch and lengths, which may be random, ranging from about 8 to 16 feet.

The braces 16 can be cut on a brace cutting machine, such as, for example, the brace cutting machine described in U.S. Provisional Pat. Application Ser. No. 60/509,868, filed on Oct. 10, 2003, which is incorporated herein in its entirety by this reference to it. The brace cutting machine can have a movable cutting head and movable part holding fixture, which together provide at least two axes of motion. The motion of the head and fixture can be driven by servo motors, which in turn can be controlled by computer controllers. Software can be used to interpret digital models or drawings of the braces, and send corresponding signals to the servo motors to move the cutting head relative to the fixtured brace 16 as required to machine the brace 16.

The brace cutting machine can be used to cut desired end configurations on the ends of the brace 16. The end configurations present surfaces that facilitate joining the braces 16 to the knife 12.

In accordance with the present invention, the same brace cutting machine can be used to produce the punch apertures 20 in the brace 16 through motions of the head and fixture. Furthermore, the machining to produce the end configurations and the punch apertures 20 can be performed on the same set-up. In other words, the stock (or raw) material for the brace need only be secured to the fixture once for complete machining of the brace 16. This method allows the punch 100 to be positioned accurately relative to the cutting knife 12 in the die assembly 10.

In addition to cutting the end configurations and any apertures 20 for attaching punches 100, the brace cutting machine can also be used to cut the holes 18 in the brace 16 used to receive a fastener 19, such as a screw, for securing the cutting die assembly 10 to the baseboard 30.

Although the invention has been described with reference to certain specific embodiments, various modifications can be made without departing from the spirit and scope of the invention, aspects of which are described in the following claims. In particular, but without limitation, the shaft and the punch aperture 20 can be keyed to prevent rotation of the punch 100 within the aperture 20, which can facilitate assembly, and can facilitate proper orientation when using non-circular punches. Furthermore, the lower retainer 120 can be fixed to the shaft, and the upper retainer 112 releasably joined to the shaft 110, so that the punch 100 is inserted into the aperture 20 nose-end first for assembly, and the upper retainer 112, which may be a nut 121, is accessible from above the baseboard 30. In another embodiment, the punch apertures 20 can be internally threaded to engage the threaded portion of the punch 100, which can eliminate the need for a separate nut 121 or allow a separate nut 121 to function as a lock nut. Where a nut 121 is provided, the nut 121 can be tack welded to the brace 16.

In another embodiment, one of the upper and lower retainers 112, 120 can be in the form of a pin that extends through a transverse hole in the shaft 110. The pin can engage the shaft 110 in press-fit to join the pin to the shaft 110. Outer ends of the pin can extend beyond the outer surface of the shaft to provide upper or lower retaining surfaces 112, 120. In one embodiment, the pin comprises a roll pin press-fit into the transverse hole in the shaft 110. The pin can alternatively be in the form of a set screw screwed into an internally threaded transverse hole in the shaft 110. As a further alternative, the pin can be in the form of a cotter pin having legs that are bent back around the outer surface of the shaft 110 to join the pin to the shaft 110.

The invention claimed is:

1. A die assembly for cutting a desired pattern from a sheet material, the assembly comprising:

a) a cutting knife configured to define the perimeter of a shape;

b) at least one brace extending between portions of the cutting knife on opposed sides of the perimeter, the brace having a punch aperture, c) a punch secured to the brace and positioned within the perimeter of the cutting knife, the punch comprising:

i) a hollow cutting nose having a leading end with a cutting edge for cutting a material to be punched and a trailing end opposite the leading end;

ii) a shaft extending from the trailing end of the nose and passing through an aperture in the brace;

iii) an upper retainer joined to the shaft and having an upper retainer surface abutting an upper surface of the brace;

iv) a lower retainer joined to the shaft and having a lower retainer surface abutting a lower surface of the brace; and v) an internal waste evacuation chute extending through the hollow cutting nose and through the shaft for evacuating plugs of punched material from the nose.

2. A die assembly according to claim 1 further comprising a baseboard and wherein the at least one brace is secured to the baseboard.

3. A die assembly according to claim 2 wherein the baseboard comprises a clearance aperture extending through the thickness of the baseboard and in alignment with the waste evacuation chute of the punch for evacuating waste material from the hollow punch nose through the baseboard.

4. A die assembly according to claim 3 wherein at least a portion of at least one of the shaft and the lower retainer are received in the clearance aperture.

5. A die assembly according to claim 1 wherein the evacuation chute has a first section in the hollow cutting nose with a first diameter less than the diameter of the cutting edge and a second section extending from an area on the opposite side of the first section and extending through the shaft.

6. A die assembly according to claim 1, wherein the upper retainer comprises an abutment adjacent the trailing end of the cutting nose.

7. A die assembly according to claim 6, wherein the upper retainer comprises a flange integrally joined to the shaft.

8. A die assembly according to claim 1, wherein the lower retainer comprises a nut engaged with a threaded portion of the shaft.

9. A die assembly according to claim 1, wherein the evacuation chute extends axially through the shaft.

10. A die assembly according to claim 9, wherein the evacuation chute has a first section in the hollow cutting nose with a first diameter to temporarily hold plugs of a cut material and a second section, in at least the shaft, with a larger diameter to let the plugs fall through the shaft.

* * * * *